US007309307B2

(12) United States Patent
Baenninger et al.

(10) Patent No.: US 7,309,307 B2
(45) Date of Patent: Dec. 18, 2007

(54) DEVICE FOR FOLDING FLAPS OF BOX BLANKS

(75) Inventors: Michel Baenninger, Epalinges (CH); Pierre Regazzoni, Renens (CH)

(73) Assignee: Bobst S.A. (CH)

( * ) Notice: Subject to any disclaimer, the term of this patent is extended or adjusted under 35 U.S.C. 154(b) by 53 days.

(21) Appl. No.: 11/230,005

(22) Filed: Sep. 19, 2005

(65) Prior Publication Data

US 2006/0063655 A1 Mar. 23, 2006

(30) Foreign Application Priority Data

Sep. 20, 2004 (EP) ..... 04405602

(51) Int. Cl.
*B31B 1/56* (2006.01)

(52) U.S. Cl. ..... 493/454; 493/10; 493/70; 493/183

(58) Field of Classification Search ..... 493/70, 493/10, 13, 23, 182, 183, 453, 454
See application file for complete search history.

(56) References Cited

U.S. PATENT DOCUMENTS

| | | | | |
|---|---|---|---|---|
| 3,330,185 A | | 10/1964 | Annett et al. | 93/49 |
| 4,432,745 A | | 2/1984 | Eldridge | 493/10 |
| 4,539,002 A | * | 9/1985 | Zak | 493/23 |
| 4,715,846 A | * | 12/1987 | Zak | 493/10 |
| 4,747,813 A | * | 5/1988 | Genoud et al. | 493/10 |
| 5,152,734 A | * | 10/1992 | McAdam et al. | 493/10 |
| 6,228,010 B1 | * | 5/2001 | Toriyama | 493/23 |

FOREIGN PATENT DOCUMENTS

| | | |
|---|---|---|
| CH | 464 671 | 12/1968 |
| EP | 0 481 580 A1 | 4/1992 |
| FR | 2 597 027 | 10/1987 |

OTHER PUBLICATIONS

European Search Report EP 04 40 5602 dated Feb. 2, 2005.

* cited by examiner

*Primary Examiner*—Hemant M. Dasai
(74) *Attorney, Agent, or Firm*—Ostrolenk, Faber, Gerb & Soffen, LLP

(57) ABSTRACT

A device for folding flaps of box blanks having crease lines transverse to the travel direction of the blanks, for use in a folder-gluer. A rotary member is rotatable around a transverse axis and provided with at least one folding arm. A removable linking device linking to a support secured to a frame of the folder-gluer. An adjusting device adjusts the position of the folding arm with respect to the support. A motor drives the rotary member. A synchronization device of the motor comprises an encoder in desmodromic connection with a drive mechanism for driving the box blanks in the drive direction and a detector of the passage past a reference position of the box blanks on the folder-gluer.

2 Claims, 3 Drawing Sheets

DEVICE FOR FOLDING FLAPS OF BOX BLANKS

BACKGROUND OF THE INVENTION

The present invention refers to a device for folding flaps of box blanks having crease lines transverse to the travelling direction of the blanks, for use in a folder-gluer. The device comprises a rotary member rotatable around an axis transverse to the travelling direction, provided with at least one folding member.

Devices for folding flaps of folding boxes with a folding member mounted on a transverse rotary shaft and comprising a single folder in the shape of a hook are well known. Another well known similar device comprises two hook-shaped folders which are symmetrically arranged with respect to the axis of the transverse rotary shaft. This or these folders are mounted on a central hub which is laterally movable along the transverse rotary shaft. The box blank travels above the rotary folding member and the folders will fold the flap from the rear while the box blank is travelling. Consequently, the folder should move at a higher speed than the box blank.

In order to fold the flap, the end of the folding hook must contact the flap to be folded in a favorable area situated at about two thirds of the flap length taken from the transverse crease line around which the flap must be folded. The transverse shaft of the rotary folding member is situated at a given distance from the passage plane of the blanks and, in order to work in the favorable area of the flap to be folded, it is necessary to either adapt the length of the hooks or to position shims on the central hub supporting the folding hooks. A device of this kind is described in U.S. Pat. No. 3,330,185. The main drawback of this device is the adjustment time required and the difficulty of positioning the folding hook in the favorable folding area.

To obviate the drawbacks of the aforesaid solution, FR 2,597,027 describes a device wherein a plurality of motors are controlled by a pulse converter that converts the values of the movement curves calculated by a function generator receiving data from a detector of passage of the blanks and the settings relating to the characteristic dimensions of these blanks. Each of these various motors acts according to different degrees of mobility of the device, and the motors allow optimizing the movement of the folding hooks.

However, such a solution is relatively complex and hence expensive. This complexity is mostly due to the fact that the folding device occupies a determined position on the folder-gluer, whereas the dimensions of the cardboard blanks may substantially vary. Also possible are blanks having transversely aligned flaps to be folded which are of different lengths. This implies to provide two devices on a common transverse support which are adjusted according to the respective lengths of the flaps.

SUMMARY OF THE INVENTION

The object of the present invention is to at least partly obviate the aforesaid drawbacks.

To this aim, the object of the present invention is a device for folding flaps of box blanks having crease lines that are arranged transversely to the moving direction of the blanks, for a use in a folder-gluer.

The device of the invention is simple. It can be mounted on any support adapted to the folder-gluer, which can be positioned inside of any free space in the machine. In fact, the device is entirely autonomous. The support on which it is mounted does not have any other function since the device is driven by a motor synchronized with the drive mechanism of the folder-gluer and not directly by this drive mechanism.

As will be seen from the following description, due to the great ease of mounting the device wherever there is space between the frames of the folder-gluer, this device offers new application possibilities in contrast to prior art folding devices.

Other features and advantages of the present invention will become apparent from the following description of the invention which refers to the accompanying drawings.

BRIEF DESCRIPTION OF THE DRAWINGS

The accompanying drawings illustrate, schematically and by way of example, an embodiment of the folding device according to the present invention.

DESCRIPTION OF A PREFERRED EMBODIMENT OF THE INVENTION

Figure 1:
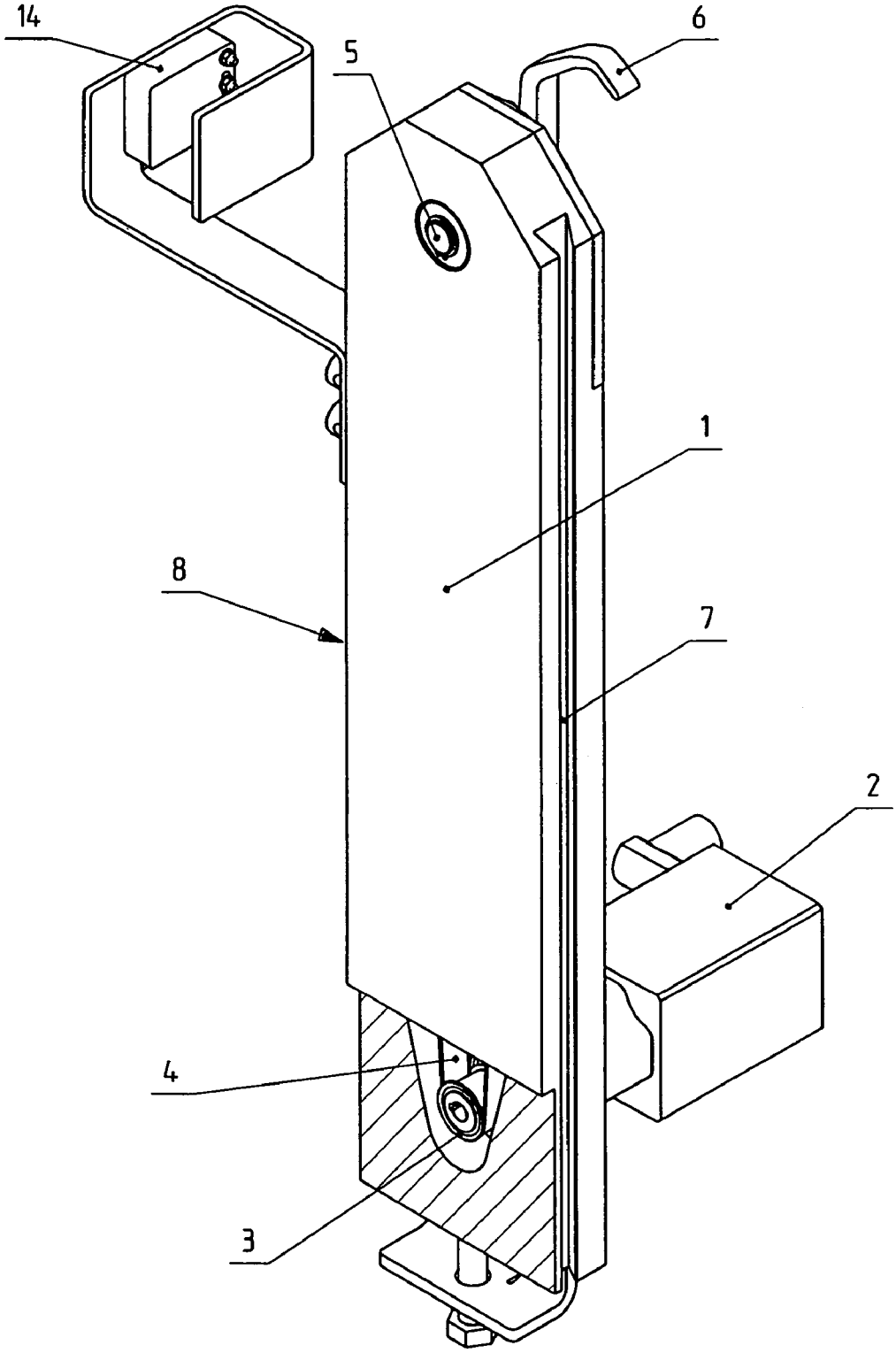
FIG. 1 is a perspective view of the device according to the invention.

The device according to the invention comprises an elongate housing 1 having two large parallel surfaces interconnected by relatively narrow lateral faces. One of the large parallel surfaces of the housing 1 carries a drive motor 2 having a shaft which extends inside this housing. A toothed pulley 3, situated in the housing 1, is wedged at the end of this shaft. The toothed pulley 3 is engaged with an endless loop toothed belt 4 engaged with a second toothed pulley (hidden by the walls of the housing 1), secured to a shaft 5 rotating in the walls of the housing 1. One end of the shaft protrudes outside the housing 1.

In the present example, the end of the shaft 5 carries two folding arms 6 that are in the shape of hooks, which are symmetrically arranged with respect to a plane containing the longitudinal axis of the shaft 5. These folding arms 6 are secured to the shaft 5, so as to be driven by it when the motor 2 drives the belt 4 engaged with the toothed pulley 3. Obviously, by adapting the speed of rotation of the motor 2, the use of only one hook-shaped folding arm would be possible.

Figure 2:
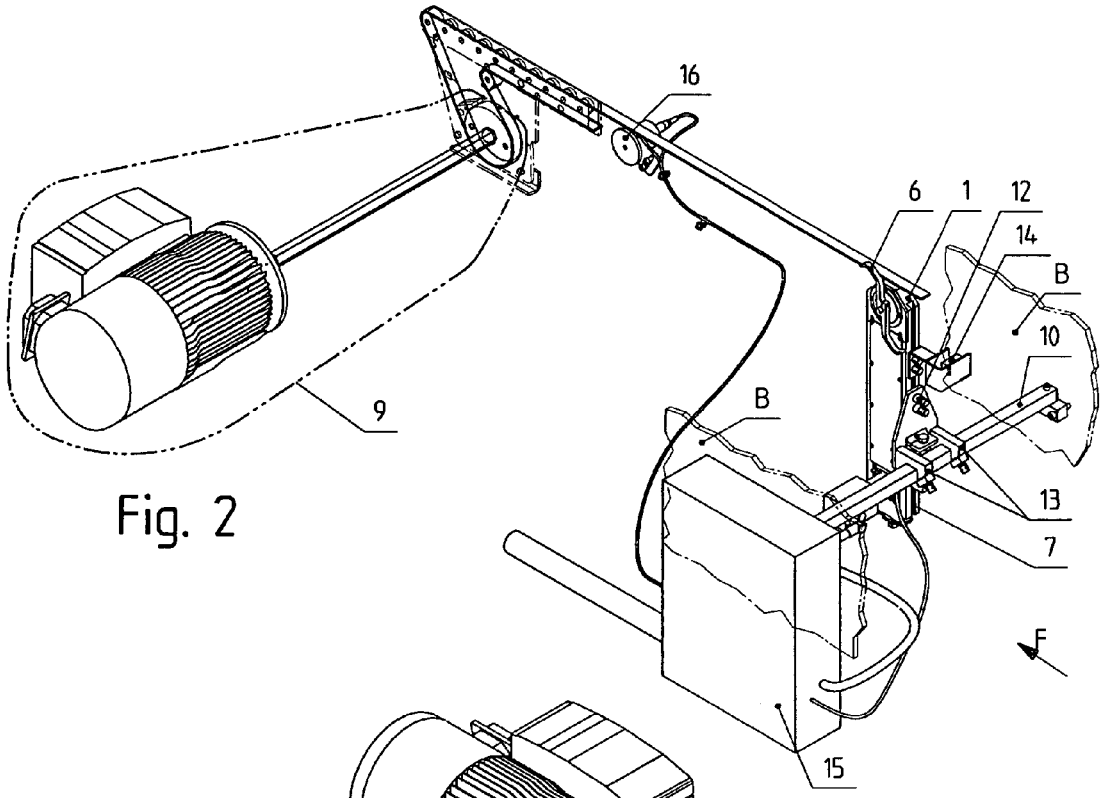
FIG. 2 is a perspective view of the device of FIG. 1 mounted on a partially illustrated folder-gluer.
Figure 3:
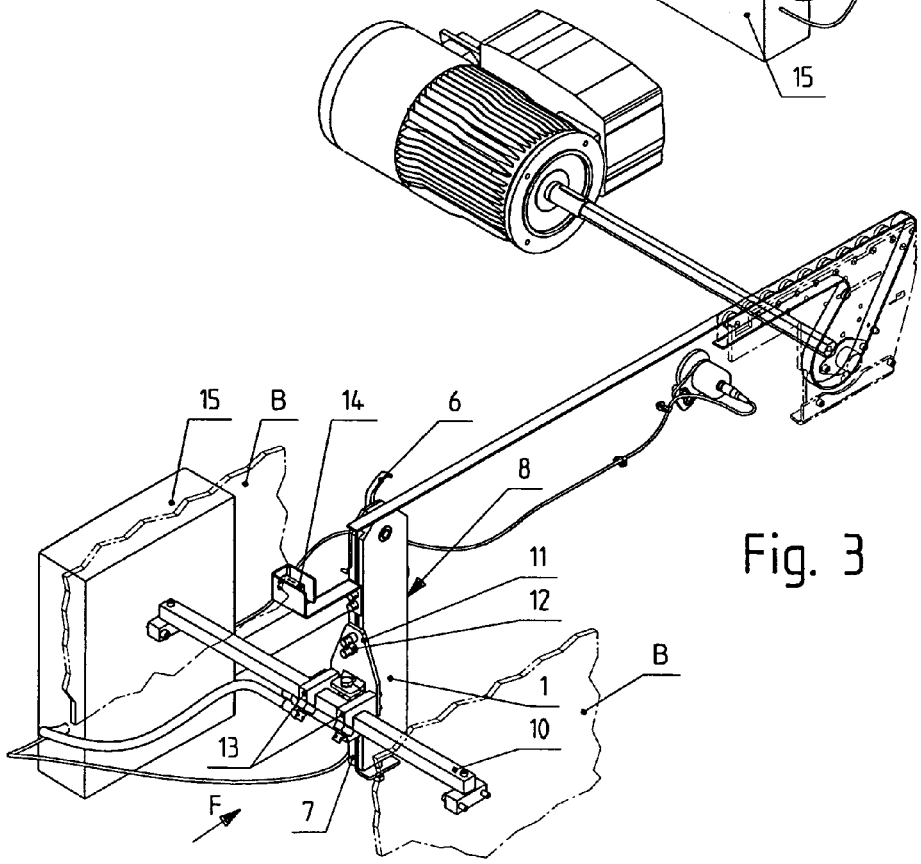
FIG. 3 is a perspective view seen from another angle of the same device mounted on a folder-gluer.

The two elongated lateral faces of the housing 1 each have a respective dovetail slide 7, 8. These slides 7, 8 are selectively used for mounting the housing on the folder-gluer. FIGS. 2 and 3 show portions of two lateral parts of the frame B and of the drive mechanism 9 of the box blanks and a support crossbar 10 of this device extending between the two lateral parts of the frame B. One of the slides 7, 8 of the housing 1 is intended to receive linking means to the support crossbar 10 which mainly comprise a linking plate 11 associated on the one hand with screw cradles 12 which engage in one of the slides 7, 8 and allow to clamp the linking plate 11 in the required position along the slide 7 or 8. This linking plate 11 further carries, on the other hand, two clamping arms 13 intended for fixing the plate 11 along the support crossbar 10. This support crossbar 10 has a polygonal section, square in the illustrated example, to allow defining the orientation of the linking plate 11 with respect to the longitudinal axis of the support crossbar 10.

The screw cradles 12 are aligned along an axis that is perpendicular to the axis on which the clamping arms are aligned, to form adjustable fixing means in two orthogonal directions.

Owing to the described device, the housing 1 thus has an adjustment possibility according to two degrees of mobility, one transverse with respect to the support crossbar 10 engaged with the clamping arms 13, the other vertical along one of the slides 7, 8 engaged with the screw cradles 12.

In order to ensure synchronization between the drive motor 2, the folding arms 6 and the drive mechanism 9 of the box blanks in the folder-gluer, the device according to the invention includes a laser cell 14 intended to detect the passage at a precise reference position of a rear edge of each box blank. This laser cell 14 is connected to a control housing 15 of the drive motor 2 (FIGS. 2 and 3). The synchronization means of the device further comprise an encoder 16 connected, on the one hand, by a desmodromic connection to the drive mechanism 9 of the box blanks (i.e. by a connection such that the speed of rotation of the encoder 16 causes a well determined speed for the rotation of the drive mechanism 9) and, on the other hand, by an electrical connection to the control housing 15 of the drive motor 2. The word "desmodromic" is derived from two Greek roots, desmos (controlled, linked) and dromos (course, track). In general mechanical terms, desmodromic refers to a mechanism comprising one or several parts linked so that said mechanism has a single degree of freedom in a way that the speed of one of the parts determines the speed of the other parts.

The collected information allows controlling the motor 2 in a synchronous manner with the forward speed of the box blanks and their passage frequency at the detection place which depends on the length of the box blanks in their travelling direction F in the folder-gluer.

The control housing 15 must further receive information about the characteristics of the blanks in order to ensure programming of the drive motor. This information is introduced by the machine operator. However, the programming mode is not a part of the present invention and is not described here.

As can be easily understood from the previous description, the described folding device operates autonomously so that it can practically be arranged at any free space on a folder-gluer. Besides, owing to its linking mode, its position can be adjusted according to the length of the flaps of the box blanks to fold. It is even possible, to position two folding devices so that they fold two flaps having transversely aligned crease lines, but the lengths of which are different, by simply varying the distance h between the axis of the shaft 5 of the folding arms 6 and the plane P of the travelling path of the box blanks (FIGS. 4 and 5), by sliding the housing 1 with respect to the linking plate 11 and by clamping the screw cradles 12 when the required distance h is obtained. A chart showing the value of h in accordance with the length of the flaps of the blanks can be drawn up for the operator.

Figure 4:
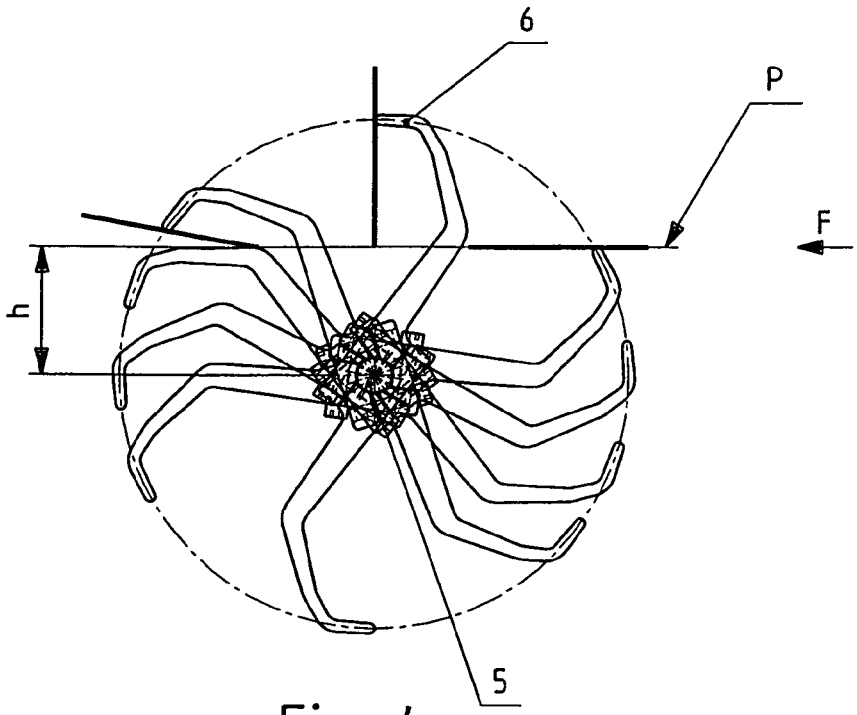
FIGS. 4 and 5 are views showing the relative positions of the circular path of the folding arms and of the rectilinear path of the box blanks for folding flaps of different lengths.
Figure 5:
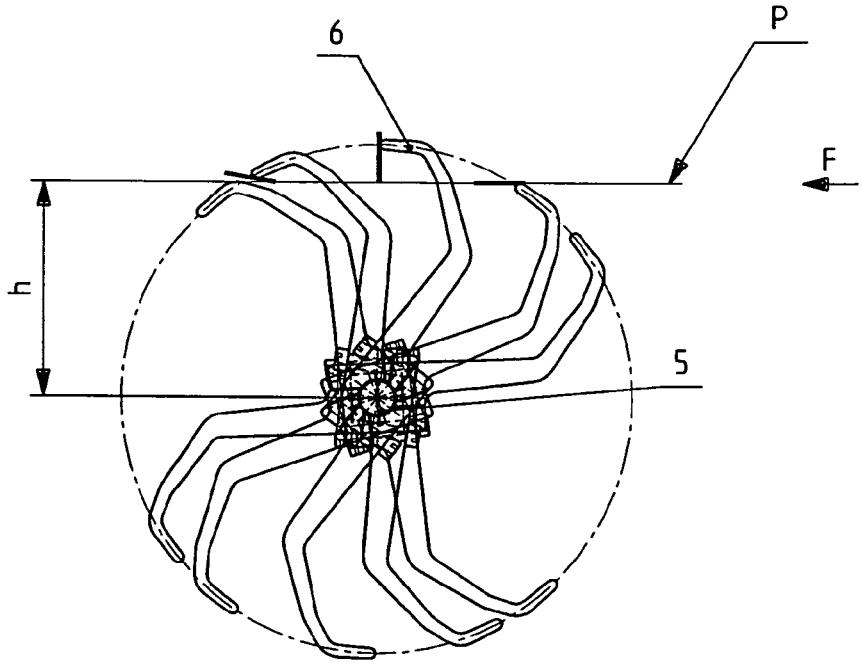

By way of example, FIGS. 4 and 5 show the relative positions of the axis of the shaft 5 of the folding arms 6 for lengths of flaps of box blanks of 20 to 25 mm, respectively 71 to 100 mm, with folding arms 6 of 100 mm radius.

Another possibility of the device according to the present invention is to use the folding arms 6 for holding the transverse crease line around which the flap is folded from inside the fold. In fact, if the crease line, during the folding operation and under the action of the force exerted on the folding flap from outside the fold, takes a convex shape inside the fold, the folding of the flap is no more possible. This risk is eliminated if the crease line is held at the beginning of the folding operation. This is possible with the device according to the present invention since there is nothing to prevent positioning of this device above the plane P of the path of the box blanks.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for folding flaps of box blanks having crease lines extending transverse to a travel direction of the blanks, for use on a folder-gluer, wherein the folder-gluer has a frame and a plurality of crossbars secured to the frame;

the device comprising a drive mechanism operable for feeding the box blanks in the travel direction;

a rotary member rotatable around an axis transverse to the travel direction and having a free end;

a motor operable for driving rotation of the at least one rotary member;

at least one folding arm rotatable with the rotary member being fixed to the free end of the rotary member;

a removable linking member removably connected to any of the support crossbars secured to the frame of the folder-gluer;

an adjusting device operable for adjusting the position of the at least one folding arm with respect to the support;

a synchronization device of the motor comprising:

an encoder in desmodromic connection with the drive mechanism of the box blanks; and a detector of the passage past a reference position of the box blanks on the folder-gluer.

2. The device according to claim 1, further comprising a slide engaged with an element or with the removable linking member; and the adjusting device for adjusting the position of the at least one folding arm has two degrees of mobility, wherein a first degree of mobility is transverse with respect to the support crossbar engaged with one element of the removable linking member, and a second degree of mobility is vertical along the slide engaged with the another element of the removable linking member.

* * * * *